US005292180A

United States Patent [19]

Schneider

[11] Patent Number: 5,292,180

[45] Date of Patent: Mar. 8, 1994

[54] UPHOLSTERED SEATING FURNITURE HAVING BACKREST PROVIDED WITH OCCUPANT'S UPPER-BODY-CONFORMING CAPABILITY

[76] Inventor: Charles Schneider, 314 S. 67th St., Omaha, Nebr. 68132

[21] Appl. No.: 989,142

[22] Filed: Dec. 11, 1992

[51] Int. Cl.[5] ..... A47C 7/02

[52] U.S. Cl. ..... 297/452.52; 297/452.48; 297/452.58

[58] Field of Search ..... 5/633, 634; 297/452, 297/460, 452.52, 452.48, 452.58; 207/80, 87

[56] References Cited

U.S. PATENT DOCUMENTS

| | | | |
|---|---|---|---|
| 1,322,292 | 11/1919 | Claus | 297/460 |
| 2,146,085 | 2/1939 | Mover | 297/460 |
| 3,086,817 | 4/1963 | Wilfert | 297/460 |
| 3,197,255 | 7/1965 | Caudill | 297/460 |
| 3,288,529 | 11/1966 | Koch | 297/460 |
| 3,378,299 | 4/1968 | Sandor | 297/452.52 |
| 3,649,077 | 3/1972 | Flint | 297/452.52 |
| 3,697,133 | 10/1972 | Wolofski | 297/460 |

*Primary Examiner*—Michael F. Trettel
*Attorney, Agent, or Firm*—George R. Nimmer

[57] ABSTRACT

The prior art discloses upholstered seating furniture having a forwardly positioned horizontal seat and a rearwardly positioned backrest (both intersected by a vertical central-plane) and which backrest includes parallel sidemembers provided with a primary-array of horizontally extending and forwardly-convex metallic springs. Herein is a novel disclosure of a secondary-array of secondary-springs that is attached to and extend convexly forwardly of the primary-array and forwardly covered with resiliently-compressive padding (hingeably existing along the vertical central-plane) whereby the paired secondary-array and padding together rearwardly flex whenever a seated occupant recumbently leans rearwardly toward the cooperating secondary-array and padding. Accordingly, the recumbently rearwardly leaning seated occupant experiences an upper-body cradling upper-body-conforming capability afforded by the concommittantly rearwardly-flexible team of secondarily-arrayed secondary-springs and frontal padding means therefor.

8 Claims, 5 Drawing Sheets

UPHOLSTERED SEATING FURNITURE HAVING BACKREST PROVIDED WITH OCCUPANT'S UPPER-BODY-CONFORMING CAPABILITY

BACKGROUND OF THE INVENTION

As indicated in appended drawing FIGS. 1 and 2, upholstered seating furniture (e.g. A) of the prior art generally comprises: a rearwardly positioned upright backrest (B); a forwardly positioned horizontal seat (C) (the backrest and seat portions being centrally intersected by a vertical central-plane (10C)); and substrate-abuttable legs (D) depending from the horizontal seat portion (C). Upright backrests typically and internally skeletally comprise a pair of vertical side members (12A, 12B) that flank said central-plane (10C) and each being positioned along a vertical rearward-plane (10R) and a vertical forward-plane (10F), each of said planes 10R and 10F perpendicularly intersecting central-plane 10C. Typically employed for completing the internal structural skeleton for a seating backrest (B) are horizontal members 11A and 11B, each of which is attached to sidemembers 12A and 12B. Customarily attached to the backrest internal skeletal members (12A. 12B) is a vertically-extending primary-array of horizontal and vertically-undulate metallic primary-springs (15A–15F), each of said primary-springs being attached to both sidemembers (12A, 12B) and extending concavely forwardly beyond said forward-plane 10F (and too horizontally across said central-plane 10C). The several primary-springs are tied-together at upright primary-bars 14 (that flank central-plane 10C) with clips 13 or weldings 13. Foam, or other resiliently-compressive padding (16) extends uprightly along the forward side of said primary-array (15A–15F). As best indicated by drawing FIG. 2, uprightly extending, flexible fabric upholstery material (17) surrounds the backrest sidemembers (12A, 12B) and too the reslliently-compressive frontal padding (16) for primary-springs (15A–15F). Thus, whenever a furniture occupant (seated upon the horizontal seat portion (C)) recumbantly leans his/her upper-body rearwardly, the several primary-springs (15A–15F) and the frontal padding (16) will concommittantly rearwardly flex, to thusly provide a modicum of upperbody comfort to the seated occupant. However, with the conventional prior art structure described hereabove, a seated occupant, rearwardly recumbently leaning along vertical-plane 10C, will sense the insecurity of being unrestrained in the horizontal directions from vertical central-plane 10C.

GENERAL OBJECTIVE OF THE INVENTION

It is accordingly the general objective of the present invention to provide an upright backrest for upholstered seating furniture that offers to a seated occupant, who recumbently leans rearwardly toward the upholstered seating backrest portion, the sense that the occupant's upper-body is being laterally cradled i.e. being comfortably horizontally restrained in the horizontal directions emanating from the upholstered seating vertical central-plane.

GENERAL STATEMENT OF THE INVENTION

With the above general objective in view, and together with other related and ancillary objectives which will become more apparent as this description proceeds, the upholstered seating furniture of the present invention (and having improved upper-body-conforming capability for a seated occupant recumbently rearwardly leaning toward the furniture upright backrest portion), and which improved upholstered seating furniture is related to prior art upholstered seating furniture having a vertically-extending primary-array of metallic primary-springs respectively extending concavely forwardly from the backrest but which improved seating furniture departs from those of the prior art to provide backrests that offer to the occupant the sense that he/she is being upper-bodily comfortably restrained cradably in both horizontal directions from the backrest central-plane, including therewith a secondary-array of horizontally extending metallic secondary-springs that respectively extend forwardly convexly from a prior art primary-array of primary-springs, and together with other permitted desireable features ancillary to said skeletally attached and forwardly extending extending secondary-array of metallic secondary-springs.

BRIEF DESCRIPTION OF THE DRAWING

In the drawing, wherein like characters refer to like parts in the several views, and in which.

DETAILED DESCRIPTION OF THE DRAWING

Figure 1:
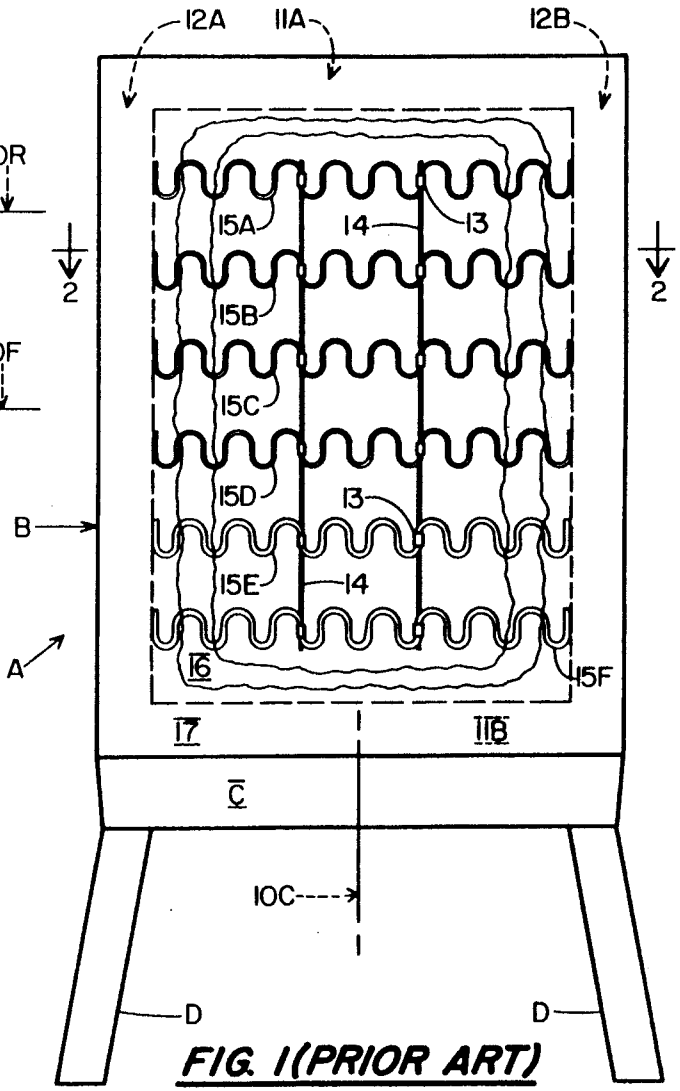
FIG. 1 (PRIOR ART)
FIG. 1 (prior art, aforedescribed) is a frontal elevational view of conventional prior art upholstered seating (A) having an upright backrest portion (B) and a horizontal seating portion (C), both portions being intersected by a vertical central-plane 10C. Portions of the upholstery-covering (17) for backrest portion (B) are removed to bare backrest interior portuons 15A–15F and 16.
Figure 2:
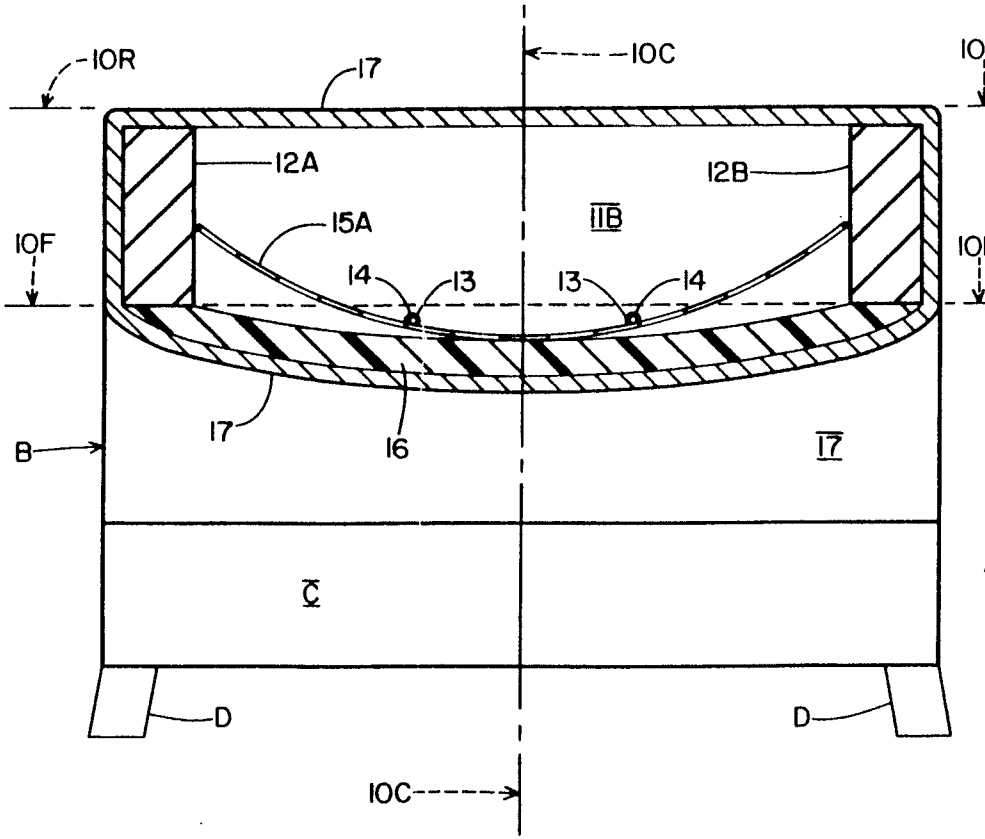
FIG. 2 (PRIOR ART)
FIG. 2 (prior art, aforedescribed) is a sectional plan view, taken along line 2—2 of FIG. 1.
Figure 3:
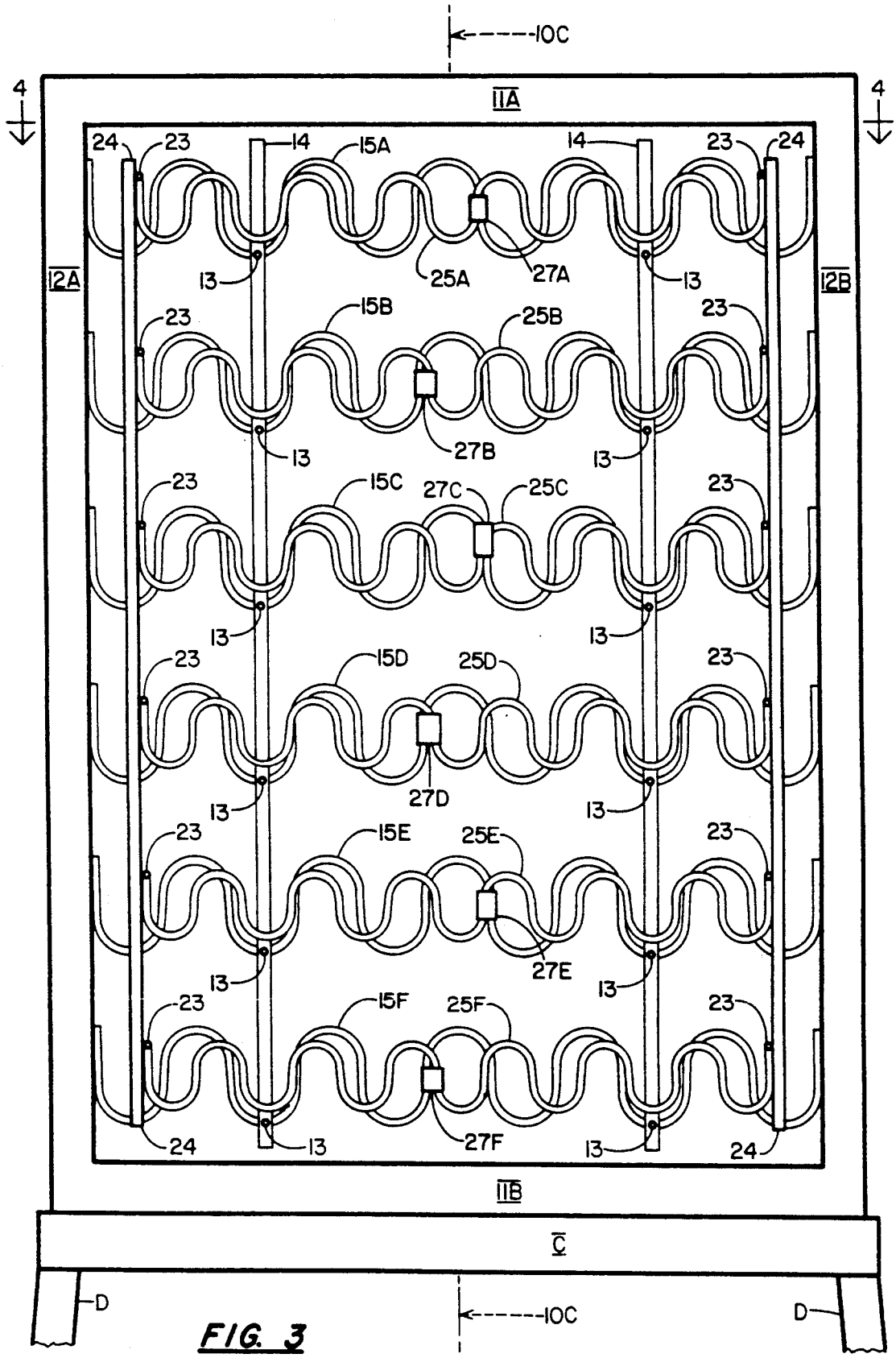
FIG. 3 is a frontal elevational view, similar to FIG. 1, of the improved backrest structure (BB) for upholstered furniture of the present invention.
Figure 4:
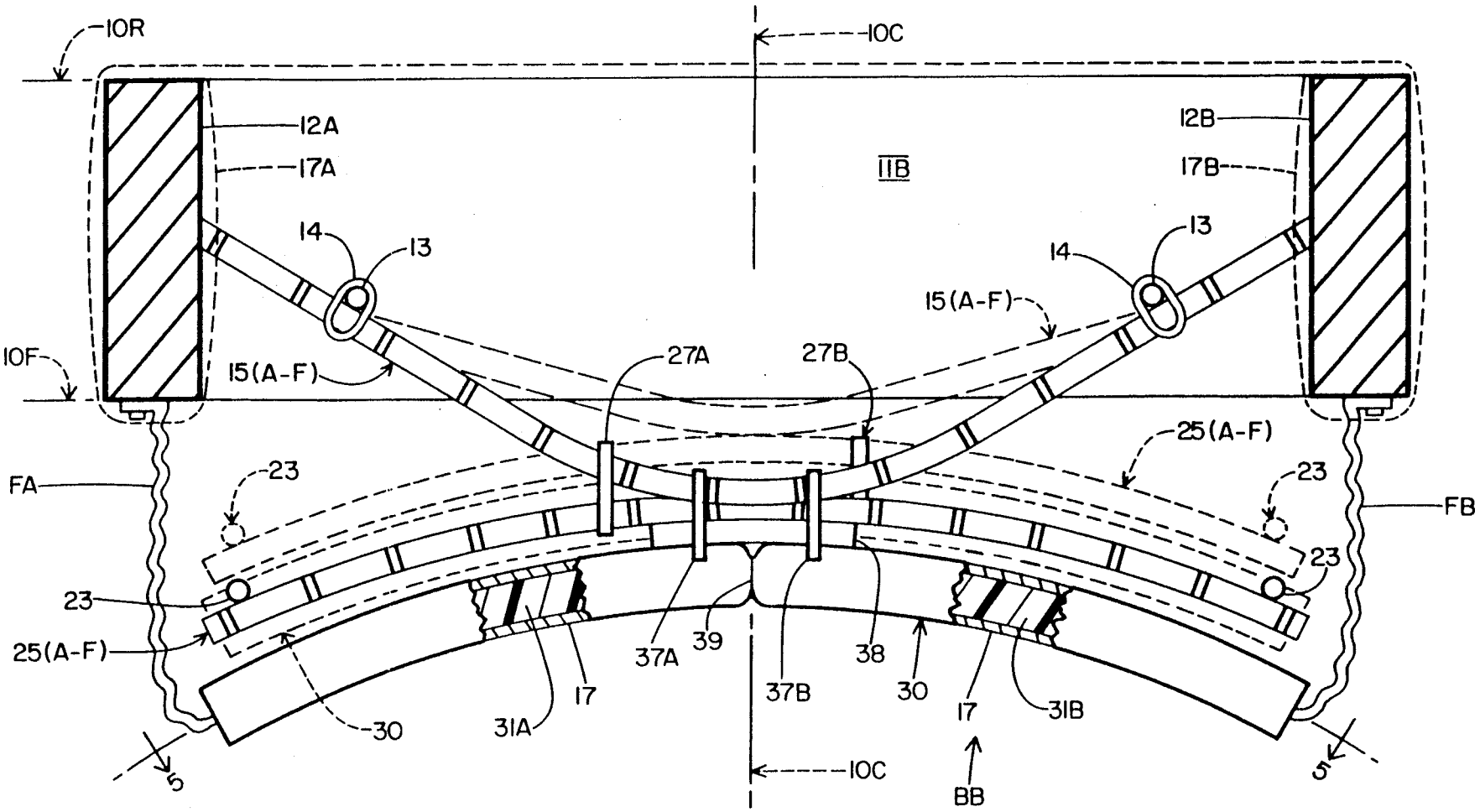
FIG. 4 is a sectional plan view taken along line 4—4 of FIG. 3.
Figure 5:
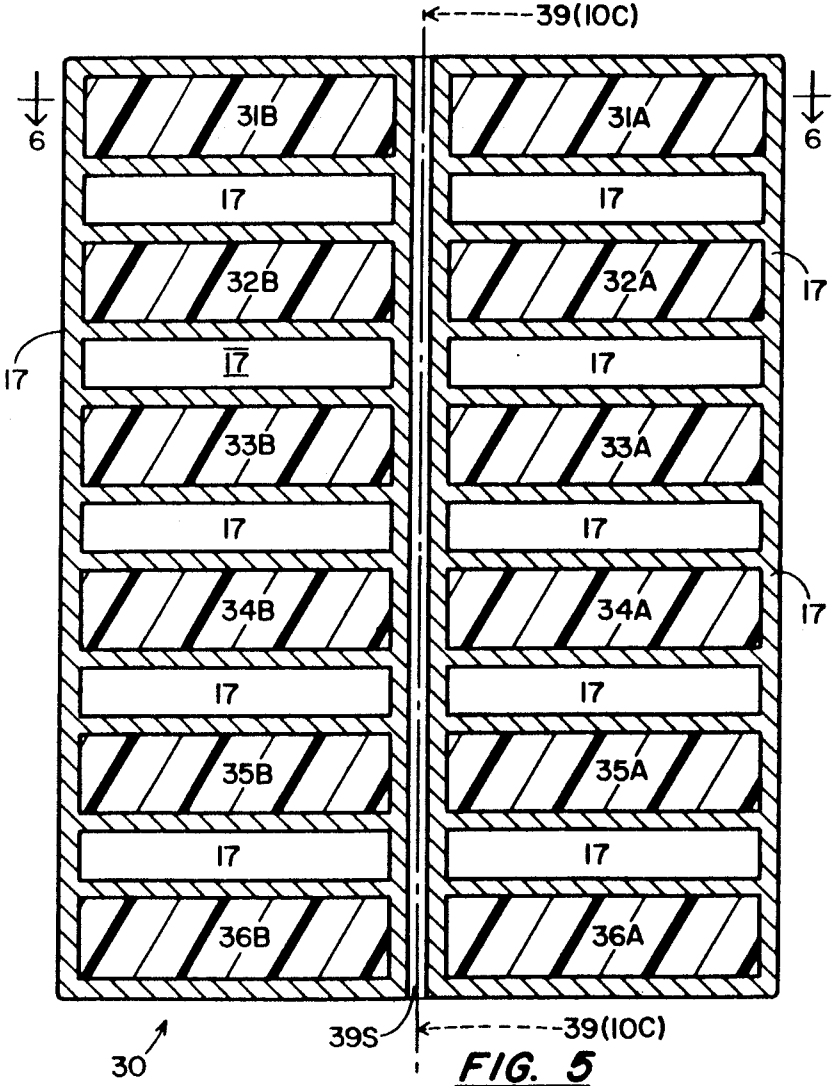
FIG. 5 is a sectional elevational view taken along lines 5—5 of FIGS. 4 and 6.

As alluded to in drawing FIGS. 3–6, the general concept for upholstered seating furniture having novel backrest portion (e.g. BB) provided with occupant's upper-body-conforming capability, retains the disclosure of "Prior Art" drawing FIGS. 1 and 2, but eschews: resiliently-compressive padding (16) directly impinging upon the primary-springs (15); and also eschews having upholstery material (17) continuously tightly encircling the backrest internal skeleton (12) and the padding (16). Improving upon the disclosure of "Prior Art" drawing FIGS. 1 and 2, the novel upright backrest portion (e.g. BB) of the present invention generally includes:

(A) a secondary-array (25) of horizontal springs attached to (27) and extending convexly forwardly of said primary-springs (15) to provide a cooperating combined-array of springs (15, 25); and (B) a substantially vertically extending resiliently-compressible padding means (30) located immediately forwardly of said secondary-array (25) and being centrally attached (37, 38) to said combined-array (15, 25, 27) and being flexible along a padding central part (10C, 39) along with rearward flexture of said combined-array of horizontal springs (15, 25, 27) whenever the seated occupant recumbently leans rearwardly toward said backrest (e.g. BB), and the said padding means (30) being loosely flexibly attached (FA, FB) to the backrest internal skeletal structure (12A, 12B).

The secondary-array (25) includes a plurality of horizontal, vertically-aligned and respectively vertically-undulate metallic springs (25A, 25B, 25C, 25D, 25E, 25F) which are respectively horizontally aligned with primary-springs (15A, 15B, 15C, 15D, 15E, 15F). All said secondary-springs 25 are attached together in vertical-alignment by upright secondary-bars 23 that outwardly flank central-plane 10C (and that also outwardly flank said primary-bars 14). At each horizontally-aligned pair of primary and secondary springs (e.g. 15A and 25A . . . 15F and 25F) there is a trans-springs mechanical joinder (e.g. clips 27A . . . 27F). Preferably, the trans-springs mechanical joinders are consecutively staggered on closely-neighboring alternating sides of said central-plane 10C. Thus, the attached (27A, 27B) secondary-array (25) extends convexly forwardly of said primary-array (15) to provide a combined-array (15, 25, 27) of mechanically-joined and uprightly arrayed primary-springs and secondary-springs.

Extending uprightly along the secondary-array of secondary-springs 25 is an apt resiliently-compressive padding means (30), and which along the vertical central-plane (10C, 39) thereof will concommitantly and conformably match the rearwardly-induced occupant flexures of said combined-array (15, 25, 27). In this regard, the padding means (30) can comprise: upright and frontally disposed flexible upholstery material (layer, 17) that is attachably sewn (19S) to a rearwardly disposed flexible backing material (layer, 18); and, said flexible layers (17, 18) being attachably sewably joined (39S) adjacent central-plane 10C to provide a vertical hinge-like central-flexure (10C, 39) for the padding assembly (e.g. 30). Flanking central-plane 10C are vertically-aligned and independently (17, 18) enclosed resiliently-compressive means (e.g. foam-bars 31A–31B . . . 36A–36B). The padding means includes a rearwardly extending central-flap (38) that is mechanically attached (e.g. clips 37A, 37B) to said combined-array (15, 25, 27). The frontally disposed padding means (e.g. 30) is not tightly confined relative the backrest internal skeleton (11, 12), but rather is loosely attached thereto (e.g. flexible wings FA and FB, to skeletal uprights 12A and 12B, respectively). However, aesthetically attractive upholstery layers (17A, 17B) might respectively independently surround the skeletal uprights (12A, 12B).

Accordingly, and considering the disclosure contained in the two immediately preceeding paragraphs, and for a seated occupant sitting upon a furniture seat (C) and recumbently leaning rearwardly toward the furniture improved backrest (BB): The joined-springs combined-array (15, 25, 27) and the frontal padding means (30) together rearwardly flex and in a condition wherein: the convex secondary-array (25) assumes a lesser-convexity-value; and the centrally-attached (37, 38) and uprightly centrally-flexible (10C, 39) padding means matches the said curvature of the secondary-array (25), but independently (FA, FB) of the backrest internal skeleton (11, 12). Accordingly, a seated (C) and rearwardly recumbently leaning occupant (toward padding 30 of backrest BB) will sense that his/her rearwardly recumbent upper-body is being conformably cradled in both horizontal directions from the furniture central-plane (10C).

Figure 7:
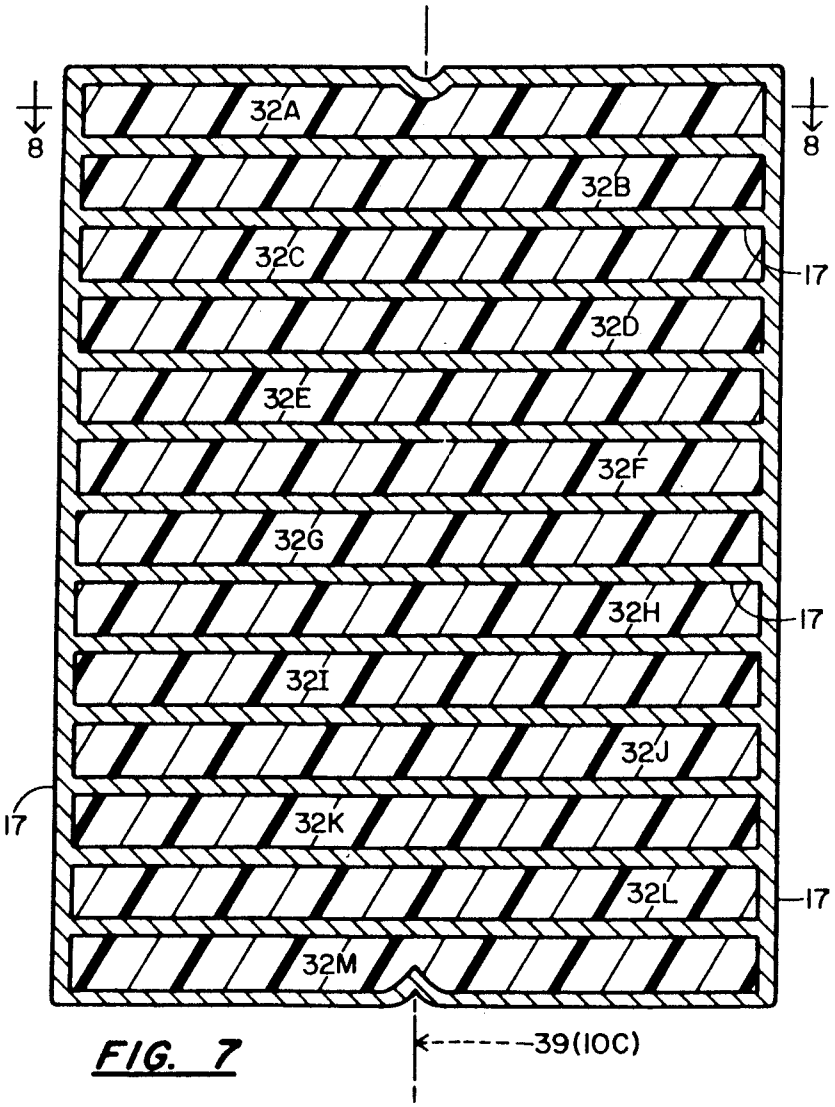
FIG. 7 is a sectional elevational view, similar to FIG. 5, of an alternate embodiment of the resiliently-compressive padding therefor.
Figure 6:
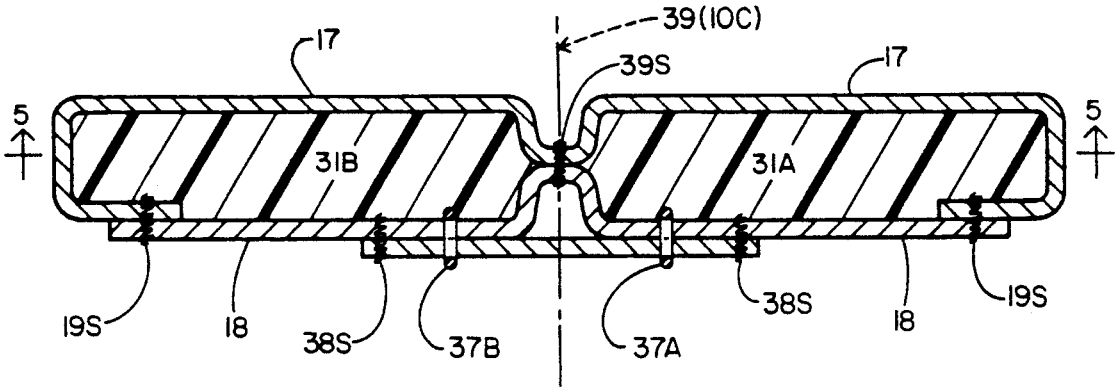
FIG. 6 is a sectional plan view of FIG. 5.
Figure 8:
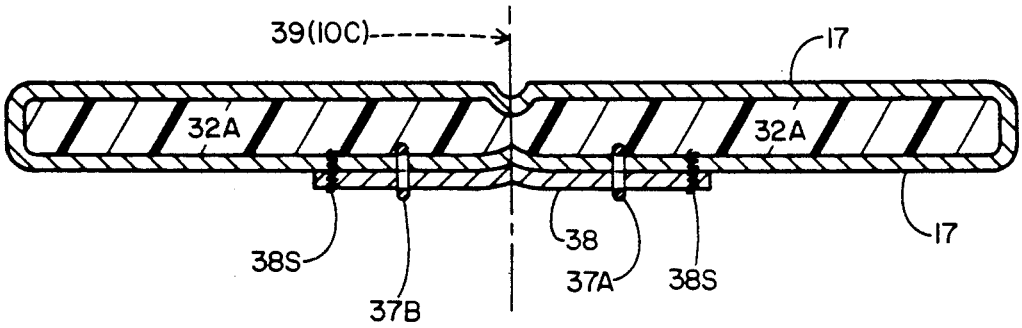
FIG. 8 is a sectional plan view of FIG. 7.

Drawing FIGS. 7 and 8 indicate that a vertically-extending central-flexure (10C, 39) type padding means might alternatively be provided by utilizing dimensionally-vertically-arrested resiliently-compressive means (e.g. laterally-lengthy and vertically-thin foam-bars (32A–32M) laterally-horizontally spanning vertical central-plane 10C and all confineably surrounded by upright flexible material (e.g. 17).

The aforedescribed seating furniture backrest (provided with occupant's upper-body-conforming capability) can be orthopaedically comfortably tailored to a prospectively-purchasing occupant's individual orthopaedic needs. Such individually customized orthopaedic tailoring might include, inter alia: tailoring the height of the padding means in accordance with the prospective-purchaser's upper-body-height; empirically selecting the resiliency-value of the respective enclosed foam-layers (e.g. 31–36); etc.

Moreover, the aforedescribed backrest (provided with occupant's upper-body-conforming capability) might be incorporated into the two laterally-terminating stations of a multi-stations sofa-type upholstered seating furniture.

From the foregoing, the construction and operation of the rearwardly positioned upright backrest for upholstered seating furniture will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. For the environment of upholstered seating furniture having a rearwardly positioned upright backrest and a forwardly positioned horizontal seat and which backrest and seat are both intersected by a vertical central-plane, said backrest comprising a pair of rigidly and spaced-apart sidemembers flanking said central-plane and lying along a vertical forward-plane that perpendicularly intersects said central-plane, said backrest sidemembers being attachably provided with a primary-array of horizontal and vertically-undulate metallic primary-springs that respectively extend concavely forwardly from said sidemembers and beyond said forward-plane, an improved backrest having cradling and upper-body-conforming capability to a seated occupant and that upper-bodily recumbently leans directionally rearwardly toward said upright backrest and comprising:

(A) a secondary-array comprising a plurality of horizontal and vertically-aligned and vertically-undulate metallic secondary-springs attachably located and extending at an abruptly-convex-value forwardly of said primary-array to provide a combined-array, each said secondary-spring being attached to a pair of upright secondary-rods flanking said central-plane, said secondary-array being capable of assuming a lesser-convexity-value whenever a said seated person leans recumbently rearwardly against said combined-array, and said attachment between primary-array and secondary-array being in the form of at least one primary-spring and horizontally aligned secondary-spring in a trans-springs joinder attachment; and (B) a substantially vertically extending resiliently-compressible padding means located immediately forwardly of said secondary-array and being attached to said combined-array and being flexible along said vertical central-axis to assume said lesser-convexity-value concommitantly with said secondary-array of secondary-springs.

2. The improved backrest of claim 1 wherein said secondary-array included secondary-springs are respectively attached to said respective primary-springs with trans-springs mechanical joinders located nearer to said central-plane than to said secondary-rods.

3. The improved backrest of claim 2 wherein there are at each vertically-arrayed and horizontally aligned primary-spring and secondary-spring a single trans-springs mechanical joinder and said joinders being collectively staggered in flanking relationship with respect to said central-plane.

4. The improved backrest of claim 1 wherein said resiliently-compressive padding means is provided with a directionally rearward and flexible central-flap intersected by said central-plane and attached to said combined-array and to the exclusion of said backrest sidemembers.

5. The improved backrest of claim 1 wherein said resiliently-compressive padding means is provided with a vertical-crease extending along said central-plane, ancillary to attainment of said lesser-convex value concommitantly with said secondary-array of secondary-springs.

6. The improved backrest of claim 1 wherein said resiliently-compressive padding means is provided with a plurality of vertically-thin and horizontally elongate resiliently-compressive foam-cells ancillary to attainment of said lesser-convex value concommitantly with said secondary-array of secondary-springs.

7. For the environment of upholstered seating furniture having a rearwardly positioned upright backrest and a forwardly positioned horizontal seat and which backrest and seat are both intersected by a vertical central-plane, said backrest comprising a pair of rigidly and spaced-apart sidemembers flanking said vertical central-plane and lying along a vertical forward-plane perpendicularly intersecting said central-plane, said backrest sidemembers being attachably provided with a primary-array of horizontal metallic primary-springs that respectively extend concavely from said sidemembers along said central-plane, an improved backrest having cradling and upper-body-conformance to a seated occupant and who upper-bodily recumbently leans directionally rearwardly toward said backrest, and said backrest for the upholstered seating comprises:

(A) a secondary-array of a plurality of horizontal and vertically-aligned metallic secondary-springs attached to and extending directionally of said primary-array to provide a combined-array; and (B) a substantially vertically extending resiliently-compressive padding means located immediately forwardly of said secondary-array and being centrally attached to said combined-array and being loosely-flexibly attached to said sidemembers, and whereby there is provided co-operating and mutually conformable secondary-array and padding means which together exhibit to a seated occupant the sensation that his/her upper-body is upper-bodily-conformed in cradle-like fashion by said secondary-array of secondary-springs.

8. The improved backrest of claim 7 wherein said resiliently-compressive padding means is structurally provided with a vertical-crease extending along said vertical central-plane, ancillary to attainment of said a lessrer-convexity value concommittantly with said secondary-array of secondary-springs.

* * * * *